US008601854B2

(12) United States Patent
Sakai

(10) Patent No.: US 8,601,854 B2
(45) Date of Patent: Dec. 10, 2013

(54) METHOD OF BENDING SHEET METAL

(76) Inventor: Satoshi Sakai, Newport Beach, CA (US)

( * ) Notice: Subject to any disclaimer, the term of this patent is extended or adjusted under 35 U.S.C. 154(b) by 531 days.

(21) Appl. No.: 13/027,012

(22) Filed: Feb. 14, 2011

(65) Prior Publication Data

US 2012/0204396 A1 Aug. 16, 2012

(51) Int. Cl.
*B21D 31/00* (2006.01)

(52) U.S. Cl.
USPC ..... 72/379.2

(58) Field of Classification Search
USPC ..... 72/14.8, 31.01, 31.1, 379.2, 702; 700/165
See application file for complete search history.

(56) References Cited

U.S. PATENT DOCUMENTS

| | | | | |
|---|---|---|---|---|
| 4,061,098 | A * | 12/1977 | Horie et al. | 72/352 |
| 5,029,462 | A * | 7/1991 | Wakahara et al. | 72/379.2 |
| 5,508,935 | A | 4/1996 | Pourbroghrat | |
| 5,689,435 | A | 11/1997 | Umney et al. | |
| 5,842,366 | A | 12/1998 | Klingel et al. | |
| 6,185,476 | B1 * | 2/2001 | Sakai | 700/182 |
| 6,553,803 | B1 | 4/2003 | Heingartner et al. | |
| 6,771,363 | B1 | 8/2004 | Van Den Berg | |
| 7,637,137 | B2 * | 12/2009 | Akamizu et al. | 72/379.2 |
| 7,643,967 | B2 | 1/2010 | Durney et al. | |
| 8,371,149 | B2 * | 2/2013 | Vogel | 72/379.2 |
| 2004/0128846 | A1 | 7/2004 | Horn | |
| 2010/0106463 | A1 | 4/2010 | Hindman et al. | |

OTHER PUBLICATIONS

Suvo, The Art of Sheet Metal Design: Tips for Accrate Bending Allowance, Calculations, http://www.brighthub.com/engineering/mechanical/articles/38675.aspx, Aug. 24, 2010.
Ronald W. Leigh, Ph.D., Bend Allowance Forumlas, Dec. 5, 2008, Copyright © 1994, 2006 Ronald W. Leigh.
Olaf Diegel, Bend Works The fine-art of Sheet Metal Bending, Complete Design Services, Jul. 2002.
O.D. Lascoe, Handbook of Fabrication Processes, ASM International, Copyright Apr. 1988.
Engineers Edge, LLC, Sheet Metal Bend Equations and Calculations—Engineers Edge, http://www.engineersedge.comisheet_metal_calc.htm, Copyright 2000-2011.
Sheet Metal Bending—Bend Allowance and KFactor, http://www.oemenclosure.com/blog/sheet-metal-bending-bend-allowance-and-k-factor/, Aug. 18, 2010.

(Continued)

*Primary Examiner* — Edward Tolan
(74) *Attorney, Agent, or Firm* — David A. Belasco; Belasco Jacobs & Townsley, LLP

(57) ABSTRACT

A method of bending sheet metal uses a test work piece of the same thickness and material as a finished piece. The test piece is bent into an angled form having an interior angle of any size. The interior angle is measured as are the height of each exterior edge above its opposite leg and the height of the apex of the angled form. Using these measurements, the interior radius of the angled form can be calculated as can the inner and outer lengths of the legs. Using these values the depth of a neutral line, which will have the same length in a work piece whether bent or not, can be determined. Once the depth of the neutral line has been calculated, a bend deduction for the final work piece may be determined and thus the required starting length is determined for any desired interior angle or leg lengths.

10 Claims, 4 Drawing Sheets

(56) References Cited

OTHER PUBLICATIONS

Custompart.Net, Sheet Metal Forming, http://www.custompartnet.com/wu/sheet-metal-forming, Copyright 2009.

Boker's Inc., Boker's, Washers and Stampings Specialists, Glossary of Prescision Metal Stamping Terms, http://www.bokers.com/resources/stamping_glossary.asp, Copyright 2008.

Lampros Georgiou, Configuring bend tables of a CAD sheet metal module, http://www.buyblueprint.com/article/78/, Oct. 26, 2009.

* cited by examiner

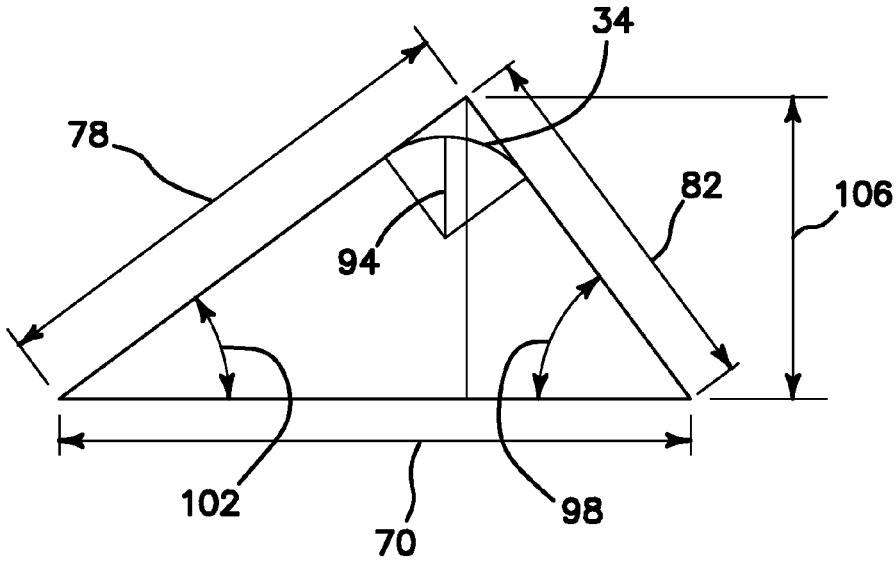
FIG. 7
FIG. 8
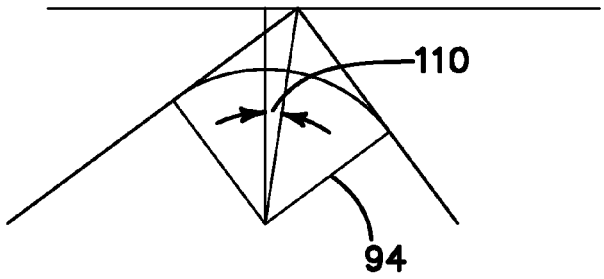
FIG. 9
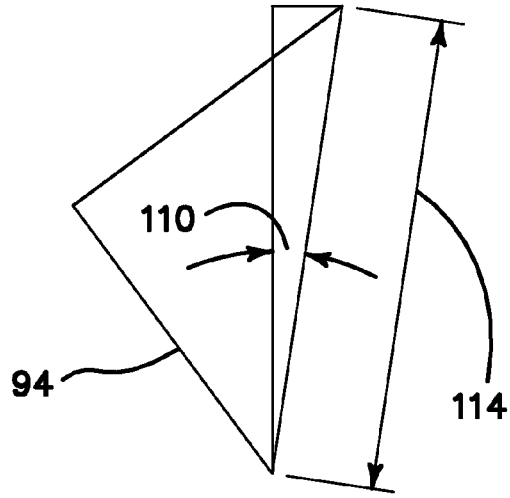

METHOD OF BENDING SHEET METAL

FIELD OF INVENTION

This invention relates to the field of metal forming and more specifically to methods for determining the correct size for a flat work piece needed to form a finished product bent at any angle.

BACKGROUND OF THE INVENTION

One of the main difficulties in sheet metal bending is determining the appropriate flat length of a piece so that it has the desired outside surface dimensions after it is bent. This is difficult because the bending process causes the inside surface of the metal to compress, and the outside surface to stretch. The amount of stretching that occurs is difficult to predict. Historically this problem has been addressed through the use of tables developed for various types and thicknesses of material based on test bends done with the material. The current method used to account for this stretching, and thus calculate the appropriate flat length, is called Bend Deduction. The Bend Deduction value is how much the sum of the two desired flange dimensions should be reduced by to get the correct fiat length. The main advantages of this method are that it is cheap and simple—one only has to measure the flange lengths A and B and the flat length of the part using calipers. However, it also has many disadvantages. The most significant problem is that if the Bend Angle is not 90 degrees, the flange lengths A and B cannot be measured accurately. Also, the Bend Deduction value depends on the desired Bend Angle, so even if an accurate Bend Deduction value is calculated for a 90 degree bend, one cannot predict what the Bend Deduction value will be for a different Bend Angle.

Another way to calculate the appropriate flat length for a part is by determining the location of the neutral line. During the bend, the material on the inside surface is compressed and the material on the outside surface is stretched. Thus there must be some location between the inside surface and the outside surface where there is no stretching or compression. This line where the molecules of the material are neither stretched nor compressed is called the neutral line. The neutral line is located at a distance t from the inner surface of the work piece. The inner surface will include the interior angle after bending.

The most important aspect of the neutral line is that its length is equal to the flat length of the piece. Thus, if we know where the neutral line is located we can determine exactly how long our flat piece should be in order to obtain the correct bent dimensions. Another important feature of the neutral line is that its location does not depend on the bend angle. This is due to the fact that once a bend has started, material that is already compressed will not start to stretch, and material that is already stretched will not start to compress, thus increasing the angle of the bend will have no effect on the location of the neutral line.

If the distance t is known, it can be used to calculate the correct flat length for any desired Bend Angle. However, the neutral line is located within the material, so obviously the distance t cannot be measured using a conventional method such as calipers. This difficulty in measurement is the reason that the Bend Deduction method is used instead of the neutral line method. There simply is no easy way to determine the location of the neutral line for a bend on the shop floor. The present invention addresses these limitations.

Various inventions have been developed to address the problem of determining the starting work piece size for a bent metal construction of a specified size.

Lascoe, O. D., Handbook of Fabrication Processes", ASM International, 1988, pp. 187 and 189 includes a chapter on Bending of Sheet Metal. This chapter includes a section on Bending Calculations. This section states that a common error in determining blank lengths is the failure to add or subtract the sheet-metal thickness when necessary. This section also states as a general rule in blank development is to divide the part into straight sections and bends or arcs. Then the length of each section is found. Often it is necessary to draw in right triangles to connect known to unknown dimensions. Trigonometry is then used to solve for an unknown side or angle. FIG. 2G-11 illustrates many bending terms including a Bevel angle (B).

Leigh, R. W., "Bend Allowance Formulas", http://ronleigh.com/ivytech/_ref-ba.htm, copyright 1994, 2006; revision Dec. 5, 2008 discloses two formulas:

an empirical formula for a K-factor as:

$$K=((R/T)/16)+0.25$$

and a Bend Allowance formula:

$$B.A.=A\cdot\pi\cdot(R+K\cdot T)/180 \text{ (A measured in degrees)}$$

Both of these equations are derived in this reference. The K-factor equation is derived from experimental data. The Bend Allowance is an equation for the arc length of the neutral axis through the bend given the bend angle A and the adjusted radius as the inside radius, R, plus the distance to the neutral axis, t, given by t=K·T, where T is the thickness of the material.

Diegel, O., "BendWorks The fine-art of Sheet Metal Bending", Complete Design Services, July 2002 discloses equations for the Bend Allowance, Bend Deduction and k-factor. Using a test sample, this reference discusses reverse engineering the k-factor by measuring the total flat length, the outside lengths of the bent section, the bend radius, the bend angle and the thickness of the material.

U.S. Patent Patent Application No. 2010/0106463, published for Hindman et al. is directed to custom equations for the unfolding of sheet metal. This system provides the ability to utilize custom equations for the unfolding of sheet metal and to determine how sheet metal bends. The custom equation solution allows users to define unfolding expressions based upon equation types that provide a reference to how the expressions will be geometrically based. The equation type may be selected by the user and can be from among a list of available types including bend allowance, bend compensation, bend deduction, and k-factor. In this regard, the equation type may be selected from the four types and appropriate equations are displayed with variables that may be customized.

U.S. Pat. No. 5,689,435, issued to Umney et al. is directed to systems and methods for automated bracket design. This reference discloses equations for the bend allowance and for the bend deduction.

U.S. Pat. No. 5,842,36, issued to Hans Klingel et al. discloses as part of a process for bending work pieces, when the work piece is released from the upper die and/or the lower die, the actual size of the bending angle is continually determined and from the actual size of the bending angle found, the change in it is determined and, as soon as the change in the actual size of the bending angle assumes a predetermined value, the actual size of the then existing bending angle is compared with the desired size. On a tooling machine for carrying out the method described, there are scanning elements and a device for determining the actual size of the bending angle that are parts of a device for determining the change in the actual size of the bending angle. The device for determining the actual size of the bending angle is connected to a comparison device for comparing the actual size of the bending angle to the desired size.

U.S. Pat. No. 7,643,967, issued to Max W. Durney et al., discloses A method of designing fold lines in sheet material includes the steps defining the desired fold line in a parent plane on a drawing system, and populating the fold line with a fold geometry including a series of cut zones that define a series of connected zones configured and positioned relative to the fold line whereby upon folding the material along the fold line produces edge-to-face engagement of the material on opposite sides of the cut zones. Alternatively, the method may include the steps storing a plurality of cut zone configurations and connected zone configurations having differing dimensions and/or shapes, defining a desired fold line in a parent plane on a drawing system, selecting a preferred cut zone and/or a preferred connected zone which have a desired shape and scale, locating a preferred fold geometry along the fold line, the preferred fold geometry including the selected cut zone and the selected connected zone, and relocating, resealing and/or reshaping the preferred fold geometry to displace, add and/or subtract at least one of the connected zones, whereby upon folding the material along the fold line produces edge-to-fact engagement of the material on opposite sides of the cut zones. A computer program product and a system configured for implementing the method of designing fold lines in sheet material is also disclosed.

It is an objective of the present invention to provide a method for accurately determining the starting size for a piece of sheet metal that is to be bent into a bent construction of a specified size. It is a further objective to provide such a method that can be repeatedly used for sheet metal of various thicknesses and materials. It is a still further objective of the invention to provide a method that can be accurately applied to sheet metal bends of any angle. It is yet a further objective to provide such a method that is easy to use and that requires a minimum of equipment. Finally, it is an objective of the invention to provide a method to accurately determine the location of the neutral line for any thickness of any work piece of any material.

While some of the objectives of the present invention are disclosed in the prior art, none of the inventions found include all of the requirements identified.

SUMMARY OF THE INVENTION

The present invention addresses all of the deficiencies of prior art methods of bending sheet metal inventions and satisfies all of the objectives described above.

1) A method of determining the starting dimensions of a sheet metal work piece prior to bending into a sheet metal construction using a test work piece formed with an obtuse interior angle, includes the steps of:

1) providing the test work piece, the test work piece is formed of a same material and has plus or minus 25% of a same thickness, T, as the sheet metal work piece;
2) measuring and recording a length, L and the thickness, T, of the test work piece;
3) bending the test work piece into an angled form, the angled form has an interior angle, Ø;
4) identifying first and second legs of the angled form;
5) measuring and recording a length for the first leg, $H_1$, and a length for the second leg, $H_2$, each of the lengths including a total distance from an outer edge of one of the legs to an outer surface of an adjacent other leg;
6) measuring and recording a length of a first line, $H_3$, descending from the interior angle, Ø, the first line, $H_3$, extending from an apex of the angled form to a second line, c, the second line, c, connecting inner edges of the angled form;
7) determining and recording the interior angle, Ø;
8) calculating a first inside flange length, $a=(H_2-T)/\cos(Ø-90)$;
9) calculating a second inside flange length, $b=(H_2-T)/\cos(Ø-90)$;
10) calculating a first outside flange length, $A=(H_1-T*\sin(Ø-90))/\cos(Ø-90)$;
11) calculating a second outside flange length, $B=(H_2-T*\sin(Ø-90))/\cos(Ø-90)$;
12) calculating a Bend Deduction, $BD=A\Leftrightarrow B-L$;
13) calculating an inside radius, r, includes the steps of:
   a) calculating a length of the line, $c=\sqrt{a^2+b^2-2ab*\cos Ø}$,
   b) calculating an angle, α, opposite the first inside flange length, a, $\alpha=\sin^{-1}((a*\sin Ø)/c)$;
   c) calculating an angle, β, opposite the second inside flange length, b, $\beta=\sin^{-1}((b*\sin Ø)/c)$;
   d) calculating a height of triangle abc, $H'=a*\sin\beta=(a*b/c)*\sin Ø$;
   e) calculating an offset angle, $\delta=90-(\beta+Ø/2)$;
   f) calculating a length of a hypotenuse, $x=r/\sin(Ø/2)$ in terms of r;
   e) calculating inside radius, r, where $\cos\delta=(r+H'-(H_3-T))/x$ and $r=((H'-(H_3-T))*\sin(Ø/2))/(\cos\alpha-\sin(Ø/2))$;
14) calculating a distance of a neutral line from an inside surface of the test work piece, $t=((2*\tan(Ø/2)*(T+r)-BD)/((\pi/180)*Ø))-r$;
15) calculating a Bend Deduction for an actual work piece having a finished interior angle, $Ø_F$, $BD_F=2*\tan(Ø_F/2)(T+r)-(t+r)(\pi/180)*Ø_F$;
16) calculating a starting length, $L_F$ for a work piece having desired outside flange lengths $A_F$ and $B_F$, $L_F=A_F+B_F-BD_F$; and
17) applying the starting length, $L_F$ to the sheet metal work piece prior to bending into a sheet metal construction having the obtuse interior angle, $Ø_F$.

2) In a variant of the invention, the step of determining the interior angle, Ø, further includes the steps of 1) measuring a length of a line, C, extending from the outer edge of the first leg to the outer edge of the second leg; and
2) iteratively substituting values for Ø where the first outside flange length, $A=(H_1-T*\sin(Ø-90))/\cos(Ø-90)$ and the second outside flange length, $B=(H_2-T*\sin(Ø-90))/\cos(Ø-90)$ until $C^2=A^2+B^2-2AB*\cos(Ø)$.

3) In another variant, the step of measuring and recording the length for the first leg, $H_1$, the length for said second leg. $H_2$ and the first line, $H_3$ further comprises using calipers to measure the lengths $H_1$, $H_2$ and $H_3$.

4) In yet another variant, the step of measuring and recording the length for the first leg, $H_1$, the length for the second leg, $H_2$ and the first line, $H_3$, further includes using optical scanning and image processing technology to measure the lengths $H_1$ and $H_2$.

5) In still another variant, the step of measuring and recording the length for the first leg, $H_1$, the length for the second leg, $H_2$ and the first line, $H_3$, further includes using a height gauge to measure the lengths $H_1$, $H_2$ and $H_3$, 6) In yet a further variant of the invention, a method of determining the starting dimensions of a sheet metal work piece prior to bending into a sheet metal construction using a test work piece formed with an acute interior angle, includes the steps of 1) providing the test work piece, the test work piece is formed of a same material and has plus or minus 25% of a same thickness, T, as the sheet metal work piece;
2) measuring and recording a length, L and the thickness, T, of the test work piece;
3) bending the test work piece into an angled form, the angled form has an interior angle, Ø;
4) identifying first and second legs of the angled form;
5) measuring and recording a length for the first leg, $H_1$, and a length for the second leg, $H_2$, each of the lengths including a total distance from an outer edge of one of the legs to an outer surface of an adjacent other leg;
6) measuring and recording a length of a first line, $H_3$, descending from the interior angle, Ø, the first line, $H_3$, extending from an apex of the angled form to a second line, c, the second line, c, connecting inner edges of the angled form;
7) measuring and recording the interior angle, Ø;
8) calculating a first inside flange length, $a=(H_1-T-T*\sin(90-Ø))/\cos(90-Ø)$;
9) calculating a second inside flange length, $b=(H_2-T-T*\sin(90-Ø))/\cos(90-Ø)$;
10) calculating a first outside flange length, $A=H_1/\cos(90-Ø)$;
11) calculating a second outside flange length, $B=H_2/\cos(90-Ø)$;
12) calculating a Bend Deduction, $BD=A+B-L$;
13) calculating an inside radius, r, includes the steps of:
   a) calculating a length of the line, $c=\sqrt{a^2+b^2-2ab*\cos Ø}$;
   b) calculating an angle, α, opposite the first inside flange length, a, $\alpha=\sin^{-1}((a*\sin Ø/c))$;
   c) calculating an angle, β, opposite the second inside flange length, b, $\beta=\sin^{-1}((b*\sin Ø)/c)$;
   d) calculating a height of triangle abc, $H^{!}=a*\sin\beta=(a*b/c)*\sin Ø$;
   e) calculating an offset angle, $\delta=90-(\beta+Ø/2)$;
   f) calculating a length of a hypotenuse, $x=r/\sin(Ø/2)$ in terms of r;
   g) calculating inside radius, r, where $\cos\delta=(r+H^{!}-(H_3-T))/x$ and $r=((H^{!}-(H_3-T))*\sin(Ø/2))/(\cos\alpha-\sin(Ø/2))$
14) calculating a distance of a neutral line from an inside surface of the test work piece, $t=((2*\tan(Ø/2)*(T+r)-BD)/((\pi/180)*Ø))-r$;
15) calculating a Bend Deduction for an actual work piece having a finished interior angle, $Ø_F$, $BD_F=2*\tan(Ø_F/2)(T+r)-(t+r)(\pi/180)*Ø_F$;
16) calculating a starting length, $L_F$ for a work piece having desired outside flange lengths $A_F$ and $B_F$, $L_F=A_F+B_F-BD_F$; and
17) applying the starting length, $L_F$ to the sheet metal work piece prior to bending into a sheet metal construction has the obtuse interior angle, $Ø_F$.

7) In still a further variant, the step of determining the interior angle, Ø, further includes the steps of:

1) measuring a length of a line, C, extending from the outer edge of the first leg to the outer edge of the second leg; and
2) calculating the interior angle, $Ø,=180-\sin^{-1}(H_1/C)-\sin^{-1}(H_2/C)$, 8) In another variant, the step of measuring and recording the length for the first leg, $H_1$, the length for the second leg, $H_2$ and the first line, $H_3$ further comprises using calipers to measure the lengths $H_1$, $H_2$ and $H_3$.

9) In yet another variant, the step of measuring and recording the length for the first leg, $H_1$, the length for the second leg, $H_2$ and the first line, $H_3$ further includes using optical scanning and image processing technology to measure the lengths $H_1$, $H_2$ and $H_3$.

10) In a final variant, the step of measuring and recording the length for the first leg, $H_1$, the length for the second leg, $H_2$ and the first line, $H_3$ further includes using a height gauge to measure the lengths $H_1$. $H_2$ and $H_3$.

An appreciation of the other aims and objectives of the present invention and an understanding of it may be achieved by referring to the accompanying drawings and the detailed description of a preferred embodiment.

DESCRIPTION OF THE DRAWINGS

FIG. 7 is a schematic view of a triangle used to calculate the internal radius of the angled form created from the test work piece;

FIG. 8 is an enlarged view of the apex of the FIG. 7 embodiment, further illustrating the calculation of the internal radius;

FIG. 9 is a further enlarged view of a portion of the FIG. 8 embodiment, illustrating the details of the calculation of the internal radius;

DETAILED DESCRIPTION OF THE PREFERRED EMBODIMENT

Figure 1:
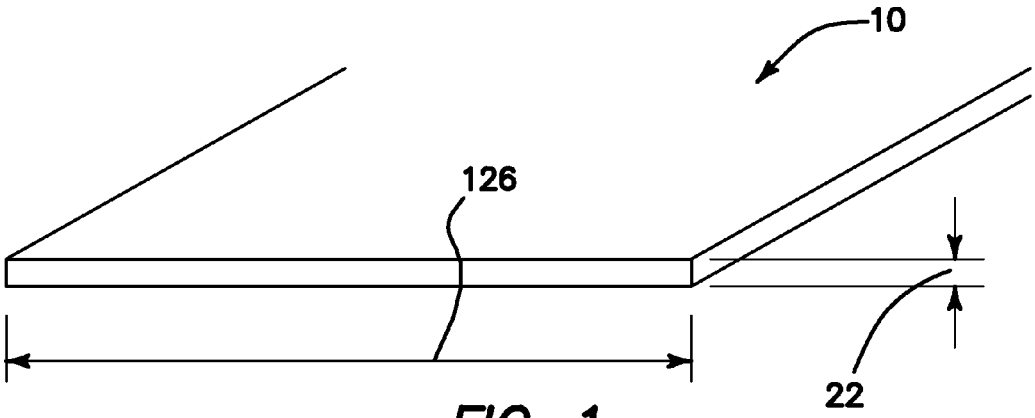
FIG. 1 is a perspective view of a sheet metal work piece prior to bending.
Figure 2:
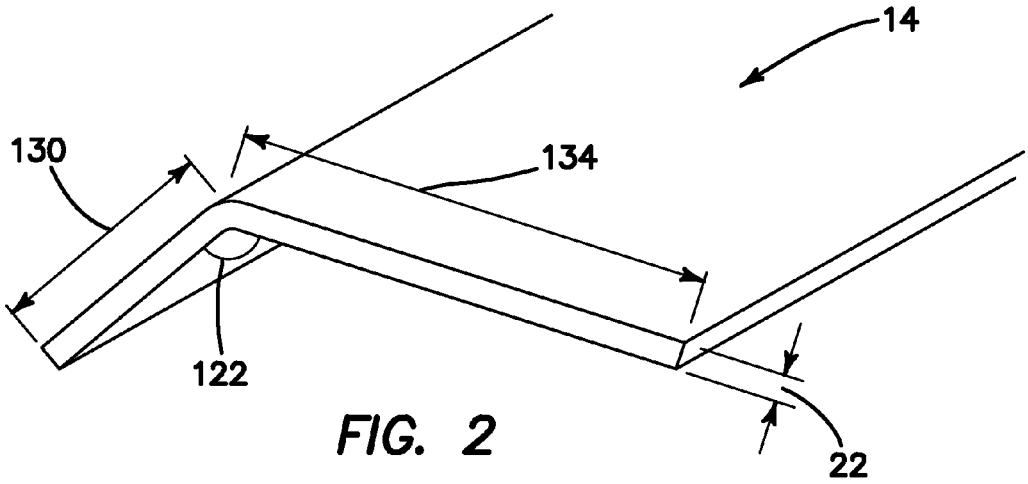
FIG. 2 is a perspective view of the FIG. 1 embodiment subsequent to bending.
Figure 3:
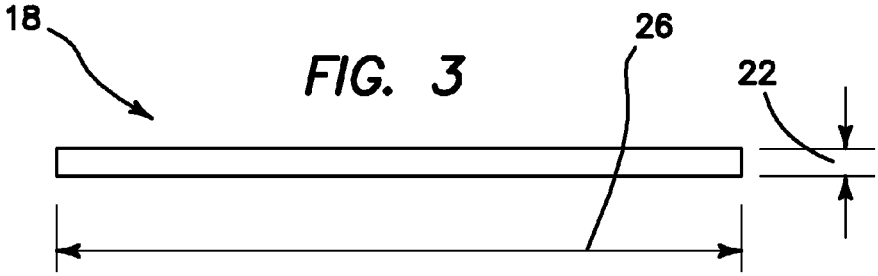
FIG. 3 is a side elevational view of a test work piece prior to bending.
Figure 4:
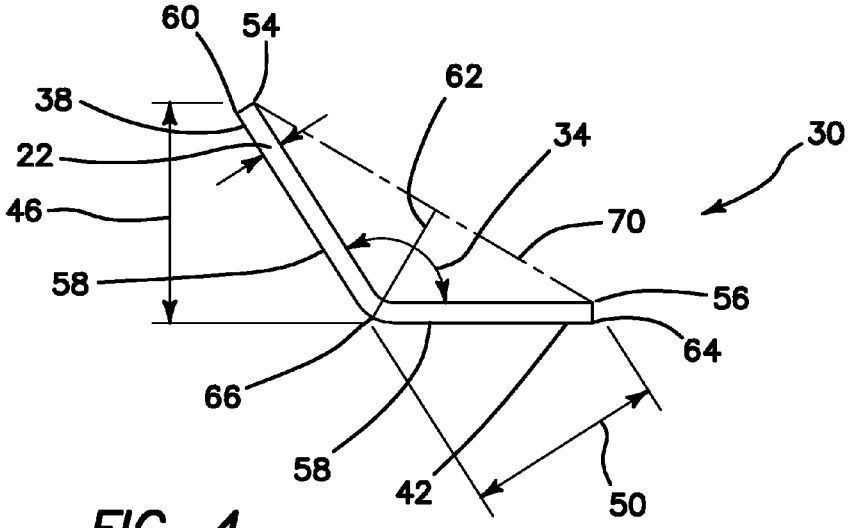
FIG. 4 is a side elevational view of the angled form created from the test work piece having an obtuse interior angle illustrating the measurement of the heights of the legs of the angled form.
Figure 5:
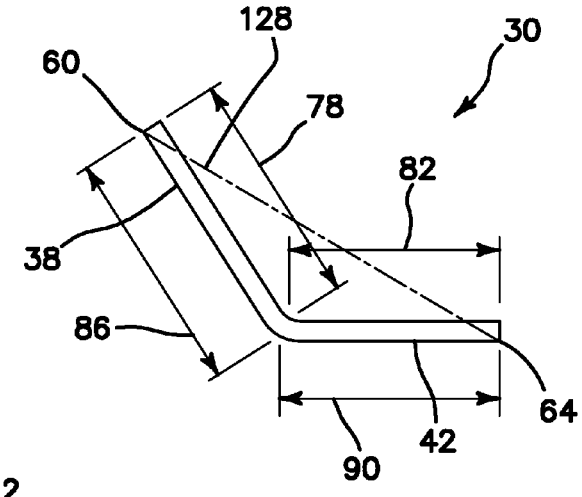
FIG. 5 is a side elevational view of the angled form created from the test work piece having an obtuse interior angle illustrating the calculation of the lengths of the inside and outside flange lengths.
Figure 6:
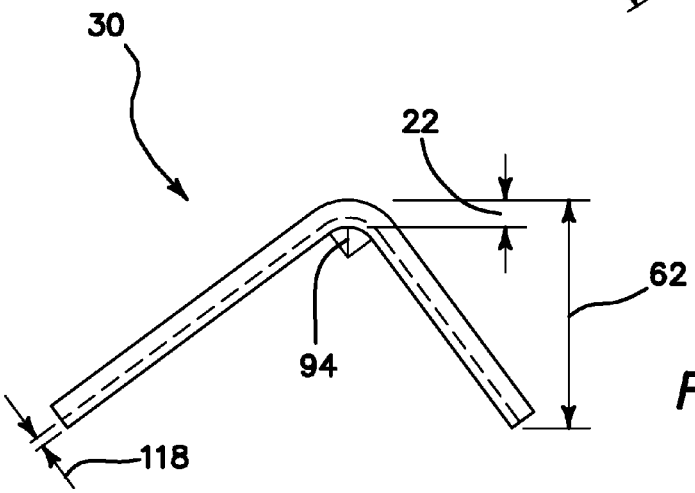
FIG. 6 is an enlarged side elevational view of the angled form illustrating the calculation of the neutral line t.

1) FIGS. 1-9 illustrate a method of determining the starting dimensions of a sheet metal work piece prior to bending 10 into a sheet metal construction 14 using a test work piece 18 formed with an obtuse interior angle, includes the steps of:

1) providing the test work piece 18, as illustrated in FIGS. 1-3, the test work piece 18 is formed of a same material and has plus or minus 25% of a same thickness 22, T, as the sheet metal work piece 10;
2) measuring and recording a length 26, L and the thickness 22, T, of the test work piece 18;
3) bending the test work piece 18 into an angled form 30, as illustrated in FIGS. 4 and 5, the angled form 30 has an interior angle 34, Ø;

4) identifying first 38 and second 42 legs of the angled form 30;

5) measuring and recording a length for the first leg 46, $H_1$, and a length for the second leg 50, $H_2$, each of the lengths 46, 50 including a total distance from an inner edge 54, 56 of one of the legs 38, 42 to an outer surface 58 of an adjacent other leg 38, 42;

6) measuring and recording a length of a first line 62, $H_3$, descending from the interior angle 34, Ø, the first line 62, $H_3$, extending from an apex 66 of the angled form 30 to a second line 70, c, the second line 70, c, connecting inner edges 54, 56 of the angled form 30;

7) determining and recording the interior angle 34, Ø;

8) calculating a first inside flange length 78, $a=(H_1-T)/\cos(Ø-90)$;

9) calculating a second inside flange length 82, $b=(H_2-T)/\cos(Ø-90)$;

10) calculating a first outside flange length 86, $A=(H_1-T*\sin(Ø-90))/\cos(Ø-90)$;

11) calculating a second outside flange length 90, $B=(H_2-T*\sin(Ø-90))/\cos(Ø-90)$;

12) calculating a Bend Deduction, BD=A+B−L;

13) calculating an inside radius 94, r, as illustrated in FIGS. 6-9, includes the steps of:

a) calculating a length of the line 70, $c=\sqrt{a^2+b^2-2ab*\cos Ø}$, b) calculating an angle 98, α, opposite the first inside flange length 78, a, $\alpha=\sin^{-1}((a*\sin Ø)/c)$;

c) calculating an angle 102, β, opposite the second inside flange length 82, b, $\beta=\sin^{-1}((b*\sin Ø)/c)$;

d) calculating a height of triangle abc 106, $H^1=a*\sin\beta=(a*b/c)*\sin Ø$;

c) calculating an offset angle 110, $\delta=90-(\beta+Ø/2)$;

f) calculating a length of a hypotenuse 114, $x=r/\sin(Ø/2)$ in terms of 94, r;

e) calculating inside radius 94, r, where $\cos\delta=(r+H^1-(H_3-T))/x$ and $r=((H^1-(H_3-T))*\sin(Ø/2))/(\cos\alpha-\sin(Ø/2))$;

14) calculating a distance of a neutral line from an inside surface of the test work piece 118, $t=((2*\tan(Ø/2)*(T+r)-BD)/((\pi/180)*Ø))-r$;

15) calculating a Bend Deduction for an actual work piece having a finished interior angle 122, $Ø_F$, $BD_F=2*\tan(Ø_F/2)(T+r)-(t+r)(\pi/180)*Ø_F$, as illustrated in FIGS. 1 and 2;

16) calculating a starting length 126, $L_F$ for a work piece having desired outside flange lengths 130, $A_F$ and 134, $B_F$, $L_F=A_F+B_F-BD_F$; and 17) applying the starting length 126, $L_F$ to the sheet metal work piece prior to bending 10 into a sheet metal construction 14.

2) In a variant of the invention, as illustrated in FIGS. 4 and 5, the step of determining the interior angle, Ø, further includes the steps of:

1) measuring a length of a line 128, C, as illustrated in FIGS. 4 and 5, extending from the outer edge 60 of the first leg 38 to the outer edge 64 of the second leg 42; and; and 2) iteratively substituting values for Ø where the first outside flange length, 86, $A=(H_1-T*\sin(Ø-90))/\cos(Ø-90)$ and the second outside flange length, 90, $B=(H_2-T*\sin(Ø-90))/\cos(Ø-90)$ until $C^2=A^2+B^2-2AB*\cos(Ø)$, 3) In another variant, the step of measuring and recording the length for the first leg 46, $H_1$, the length for the second leg 50, $H_2$ and the first line 62, $H_3$ further includes using calipers to measure the lengths 46, $H_1$, 50, $H_2$ and 62, $H_3$, 4) In yet another variant, the step of measuring and recording the length for the first leg 46, $H_1$, the length for the second leg 50, $H_2$ and the first line 62, $H_3$ further includes using optical scanning and image processing technology to measure the lengths 46, $H_1$, 50, $H_2$ and 62, $H_3$.

5) In still another variant, the step of measuring and recording the length for the first leg 46, $H_1$, the length for the second leg 50, $H_2$ and the first line 62, $H_3$ further includes using a height gauge to measure the lengths 46, $H_1$, 50, $H_2$ and 62, $H_3$.

Figure 10:
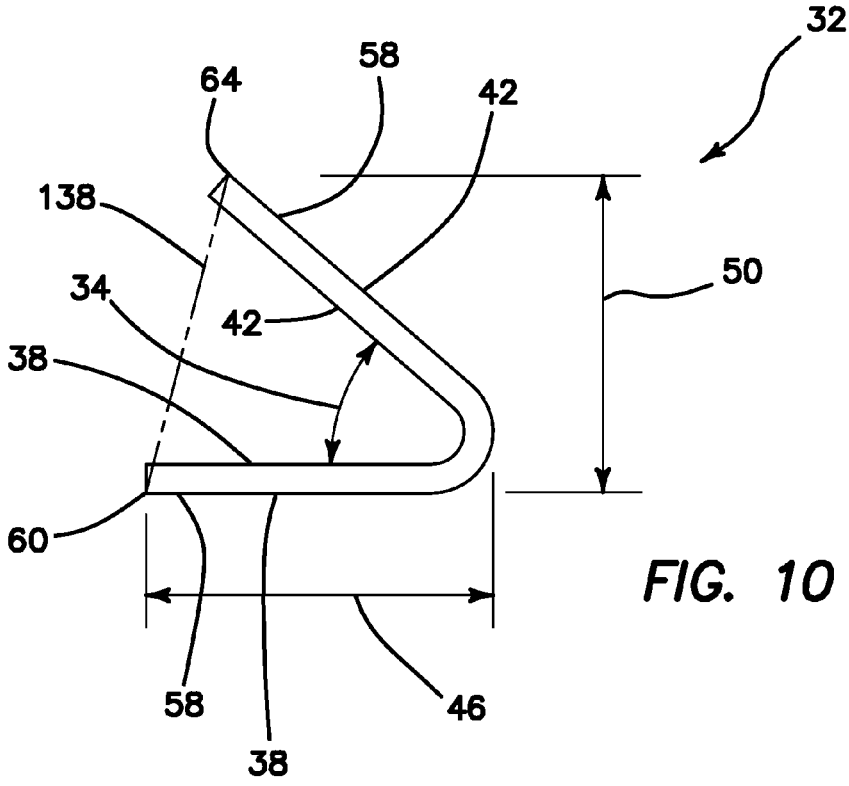
FIG. 10 is a side elevational view of the angled form created from the test work piece having an acute interior angle illustrating the measurement of the heights of the legs of the angled form.
Figure 11:
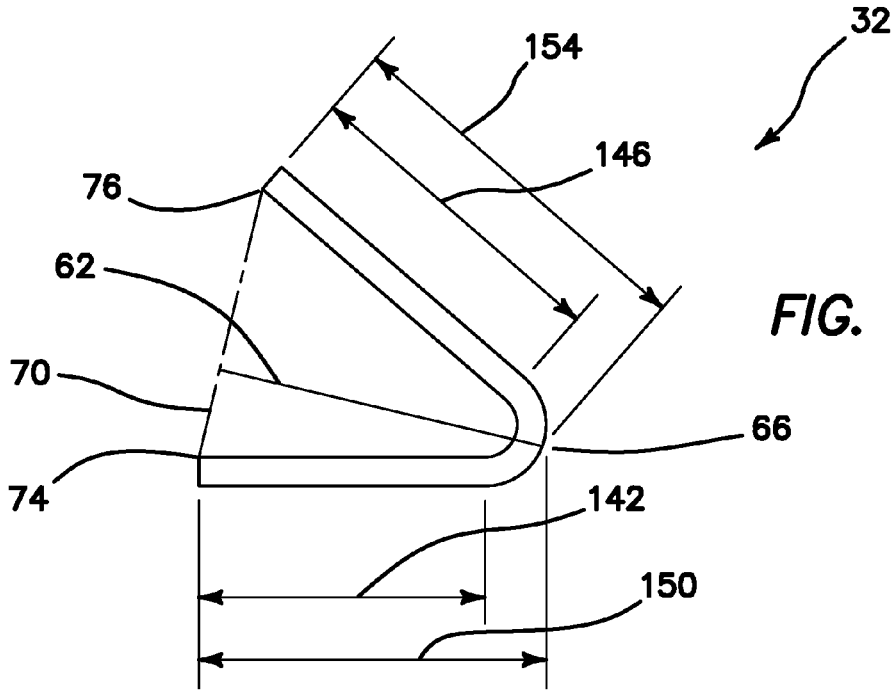
FIG. 11 is a side elevational view of the angled form created from the test work piece having an acute interior angle illustrating the calculation of the lengths of the inside and outside flange lengths.

6) In yet a further variant of the invention, a method of determining the starting dimensions of a sheet metal work piece prior to bending 10 into a sheet metal construction 14 using a test work piece 18 formed with an acute interior angle, includes the steps of:

1) providing the test work piece 18, as illustrated in FIGS. 1-3, the test work piece 18 is formed of a same material and has plus or minus 25% of a same thickness 22, T, as the sheet metal work piece 10;

2) measuring and recording a length 26, L and the thickness 22, T, of the test work piece 18;

3) bending the test work piece 18, as illustrated in FIGS. 10 and 11, into an angled form 32, the angled form 32 has an interior angle 34, Ø;

4) identifying first 38 and second 42 legs of the angled form 32;

5) measuring and recording a length for the first leg 46, $H_1$, and a length for the second leg 50, $H_2$, each of the lengths 46, 50 including a total distance from an outer edge 60, 64 of one of the legs 38, 42 to an outer surface 58 of an adjacent other leg 38, 42;

6) measuring and recording a length of a first line 62, $H_3$, descending from the interior angle 34, Ø, the first line 62, $H_3$, extending from an apex 66 of the angled form 32 to a second line 70, c, the second line 70, c, connecting inner edges 74 of the angled form 32;

7) determining and recording the interior angle 34, Ø;

8) calculating a first inside flange length 142, $a=(H_1-T-T*\sin(90-Ø))/\cos(90-Ø)$;

9) calculating a second inside flange length 146, $b=(H_2-T-T*\sin(90-Ø))/\cos(90-Ø)$;

10) calculating a first outside flange length 150, $A=H_1/\cos(90-Ø)$;

11) calculating a second outside flange length 154, $B=H_2/\cos(90-Ø)$;

12) calculating a Bend Deduction, BD=A+B−L;

13) calculating an inside radius 94, r, as illustrated in FIGS. 6-9, includes the steps of:

a) calculating a length of the line 70, $c=\sqrt{a^2+b^2-2ab*\cos Ø}$, b) calculating an angle 98, α, opposite the first inside flange length 78, a, $\alpha=\sin^{-1}((a*\sin Ø)/c)$;

c) calculating an angle 102, β, opposite the second inside flange length 82, b, $\beta=\sin^{-1}((b*\sin Ø)/c)$;

d) calculating a height of triangle abc 106, $H^1=a*\sin\beta(a*b/c)*\sin Ø$;

e) calculating an offset angle 110, $\delta=90-(\beta+Ø/2)$;

f) calculating a length of a hypotenuse 114, $x=r/\sin(Ø/2)$ in terms of 94, r;

e) calculating inside radius 94, r, where $\cos\delta=(r+H^1-(H_3-T))/x$ and $r=((H^1-(H_3-T))*\sin(Ø/2))/(\cos\alpha-\sin(Ø/2))$;

14) calculating a distance of a neutral line from an inside surface of the test work piece 118, $t=((2*\tan(Ø/2)*(T+r)-BD)/((\pi/180)*Ø))-r$;

15) calculating a Bend Deduction for an actual work piece having a finished interior angle 122, $Ø_F$, $BD_F=2*\tan(Ø_F/2)(T+r)-(t+r)(\pi/180)*Ø_F$ as illustrated in FIGS. 1 and 2;

16) calculating a starting length 126, $L_F$ for a work piece having desired outside flange lengths 130, $A_F$ and 134, $B_F$, $L_F=A_F+B_F-BD$; and 17) applying the starting length 126, $L_F$ to the sheet metal work piece prior to bending 10 into a sheet metal construction 14.

7) In still a further variant, the step of determining the interior angle, Ø, further includes the steps of:

1) measuring a length of a line 138, C, as illustrated in FIGS. 10 and 11, extending from the outer edge 60 of the first leg 38 to the outer edge 64 of the second leg 42; and 2) calculating the interior angle 34, $Ø,=180-\sin^{-1}(H_1/C)-\sin^{-1}(H_2/C)$.

8) In another variant, the step of measuring and recording the length for the first leg 46, $H_1$, the length for the second leg 50, $H_2$ and the length of a first line 62, $H_3$ further includes using calipers to measure the lengths 46, $H_1$, 50, $H_7$ and 62, $H_3$.

9) In yet another variant, the step of measuring and recording the length for the first leg 46, $H_1$, the length for the second leg 50, $H_2$ and the length of a first line 62, $H_3$ further includes using optical scanning and image processing technology to measure the lengths 46, $H_1$, 50, $H_2$ and 62, $H_3$.

10) In still another variant, the step of measuring and recording the length for the first leg 46, $H_1$, the length for the second leg 50, $H_2$ and the length of a first line 62, $H_3$ further includes using a height gauge to measure the lengths 46, $H_1$, 50, and 62, $H_3$.

The methods of determining the starting dimensions of a sheet metal work piece prior to bending 10 into a sheet metal construction using a test work piece formed with either an obtuse interior angle or an acute interior angle has been described with reference to particular embodiments. Other modifications and enhancements can he made without departing from the spirit and scope of the claims that follow.

The invention claimed is:

1. A method of determining the starting dimensions of a sheet metal work piece prior to bending into a sheet metal construction using a test work piece formed with an obtuse interior angle, comprising the steps of:

providing said test work piece, said test work piece being formed of a same material and having plus or minus 25% of a same thickness, T, as said sheet metal work piece;

measuring and recording a length, L and said thickness, T, of said test work piece;

bending said test work piece into an angled form, said angled form having an interior angle, Ø;

identifying first and second legs of said angled form;

measuring and recording a length for said first leg, $H_1$, and a length for said second leg, $H_2$, each of said lengths including a total distance from an outer edge of one of said legs to an outer surface of an adjacent other leg;

measuring and recording a length of a first line, $H_3$, descending from said interior angle, Ø, said first line, $H_3$, extending from an apex of said angled form to a second line, c, said second line, c, connecting inner edges of said angled form;

determining and recording said interior angle, Ø;

calculating, a first inside flange length, $a=(H_1-T)/\cos(Ø-90)$;

calculating a second inside flange length, $b=(H_2-T)/\cos(Ø-90)$;

calculating a first outside flange length, $A=(H_1-T*\sin(Ø-90))/\cos(Ø-90)$;

calculating a second outside flange length, $B=(H_2-T*\sin(Ø-90))/\cos(Ø-90)$;

calculating a Bend Deduction, $BD=A+B-L$;

calculating an inside radius, r, comprising the steps of:

calculating a length of said line, $c=\sqrt{a^2+b^2-2ab*\cos Ø}$, calculating an angle, α, opposite said first inside flange length, a, $\alpha=\sin^{-1}((a*\sin Ø)/c)$;

calculating an angle, β, opposite said second inside flange length, b, $\beta=\sin^{-1}((b*\sin Ø)/c)$;

calculating a height of triangle abc, $H^!=a*\sin\beta=(a*b/c)*\sin Ø$;

calculating an offset angle, $\delta=90-(\beta+Ø/2)$;

calculating a length of a hypotenuse, $x=r/\sin(Ø/2)$ in terms of r;

calculating inside radius, r, where $\cos\delta=(r+H!-(H_3-T))/x$ and $r=((H^!-(H_3-T))*\sin(Ø/2))/(\cos\delta-\sin(Ø/2))$ calculating a distance of a neutral line from an inside surface of said test work piece, $t=((2*\tan((90-Ø)/2)*(T+r)-BD)/((\pi/180)*(180-Ø)))-r$;

calculating a Bend Deduction for an actual work piece having a finished interior angle, $Ø_F$, $BD_F=2*\tan((90-Ø_F)/2)(T+r)-(t+r)(\pi/180)*(180-Ø_F)$;

calculating a starting length, $L_F$ for a work piece having desired outside flange lengths $A_F$ and $B_F$, $L_F=A_F+B_F-BD_F$; and applying said starting length, $L_F$ to said sheet metal work piece prior to bending into a sheet metal construction having said obtuse interior angle, $Ø_F$.

2. The method of determining the starting dimensions of a sheet metal work piece prior to bending into a sheet metal construction using a test work piece formed with an obtuse interior angle, as described in claim 1, wherein said step of determining said interior angle, Ø, further comprises the steps of:

measuring a length of a line, C, extending from said outer edge of said first leg to said outer edge of said second leg; and iteratively substituting values for Ø where said first outside flange length, $A=(H_1-T*\sin(Ø-90))/\cos(Ø-90)$ and said second outside flange length, $B=(H_2-T*\sin(Ø-90))/\cos(Ø-90)$ until $C^2=A^2+B^2-2AB*\cos(Ø)$.

3. The method of determining the starting dimensions of a sheet metal work piece prior to bending into a sheet metal construction using a test work piece formed with an obtuse interior angle, as described in claim 1, wherein said step of measuring and recording said length for said first leg, $H_1$, said length for said second leg, $H_2$ and said first line, $H_3$ further comprises using calipers to measure said lengths $H_1$, $H_2$ and $H_3$.

4. The method of determining the starling dimensions of a sheet metal work piece prior to bending into a sheet metal construction using a test work piece formed with an obtuse interior angle, as described in claim 1, wherein said step of measuring and recording said length for said first leg, H1, said length for said second leg, H2 and said first line, H3, further comprises using optical scanning and image processing technology to measure said lengths $H_1$, $H_2$ and H3.

5. The method of determining the starting dimensions of a sheet metal work piece prior to bending into a sheet metal construction using a test work piece formed with an obtuse interior angle, as described in claim 1, wherein said step of measuring and recording said length of said length for said first leg, $H_1$, said length for said second leg, $H_2$ and said first line, H3, further comprises using a height gauge to measure said lengths $H_1$, $H_2$ and H3.

6. A method of determining the starting dimensions of a sheet metal work piece prior to bending into a sheet metal construction using a test work piece formed with an acute interior angle, comprising the steps of:

providing said test work piece, said test work piece being formed of a same material and having plus or minus 25% of a same thickness, T, as said sheet metal work piece;

measuring and recording a length, L and said thickness, T, of said test work piece;

bending said test work piece into an angled form, said angled form having an interior angle, Ø;

identifying first and second legs of said angled form;

measuring and recording a length for said first leg, $H_1$, and a length for said second leg, $H_2$, each of said lengths including a total distance from an outer edge of one of said legs to an outer surface of an adjacent other leg;

measuring and recording a length of a first line, $H_3$, descending from said interior angle, Ø, said first line, $H_3$, extending from an apex of said angled form to a second line, c, said second line, c, connecting inner edges of said angled form;

measuring and recording said interior angle, Ø;

calculating a first inside flange length, $a=(H_1-T-T*\sin(90-Ø))/\cos(90-Ø)$;

calculating a second inside flange length, $b=(H_2-T-T*\sin(90-Ø))/\cos(90-Ø)$;

calculating a first outside flange length, $A=H_1/\cos(90-Ø)$;

calculating a second outside flange length, $B=H_2/\cos(90-Ø)$;

calculating a Bend Deduction, $BD=A+B-L$;

calculating an inside radius, r, comprising the steps of:

calculating a length of said line, $c=\sqrt{a^2+b^2-2ab*\cos Ø}$;

calculating an angle, α, opposite said first inside flange length, a, $\alpha=\sin^{-1}((a*\sin Ø/c))$;

calculating an angle, β, opposite said second inside flange length, b, $\beta=\sin^{-1}((b*\sin Ø)/c)$;

calculating a height of triangle abc, $H'=a*\sin\beta=(a*b/c)*\sin Ø$;

calculating an offset angle, $\delta=90-(\beta+Ø/2)$;

calculating a length of a hypotenuse, $x=r/\sin(Ø/2)$ in terms of r;

calculating inside radius, r, where $\cos\delta=(r+H'-(H_3-T))/x$ and $r=((H'-(H_3-T))*\sin(Ø/2))/(\cos\delta-\sin(Ø/2))$ calculating a distance of a neutral line from an inside surface of said test work piece, $t=(2*\tan((90-Ø)/2)*(T+r)-BD)/((\pi/180)*(180-Ø)))-r$;

calculating a Bend Deduction for an actual work piece having a finished interior angle, $Ø_F$, $BD_F=2*\tan((90-Ø_F)/2)(T+r)-(t+r)(\pi/180)*(180-Ø_F)$;

calculating a starting length, $L_F$ for a work piece having desired outside flange lengths $A_F$ and $B_F$, $L_F=A_F+B_F-BD_F$; and applying said starting length, $L_F$ to said sheet metal work piece prior to bending into a sheet metal construction having said obtuse interior angle, $Ø_F$.

7. The method of determining the starting dimensions of a sheet metal work piece prior to bending into a sheet metal construction using a test work piece formed with an acute interior angle, as described in claim 6, wherein said step of determining said interior angle, Ø, further comprises the steps of:

measuring a length of a line, C, extending from said outer edge of said first leg to said outer edge of said second leg; and calculating, the interior angle, $Ø,=180-\sin^{-1}(H_1/C)-\sin^{-1}(H_2/C)$.

8. The method of determining the starting dimensions of a sheet metal work piece prior to bending into a sheet metal construction using a test work piece formed with an acute interior angle, as described in claim 6, wherein said step of measuring and recording said length for said first leg, $H_1$, said length for said second leg, $H_2$ and said first line, $H_3$ further comprises using calipers to measure said lengths $H_1$, $H_2$ and $H_3$.

9. The method of determining the starting dimensions of a sheet metal work piece prior to bending into a sheet metal construction using a Lest work piece formed with an acute interior angle, as described in claim 6, wherein said step of measuring and recording said length for said first leg, H1, said length for said second leg, H2 and said first line, H3, further comprises using optical scanning and image processing technology to measure said lengths $H_1$, $H_2$ and H3.

10. The method of determining the starting dimensions of a sheet metal work piece prior to bending into a sheet metal construction using a test work piece formed with an acute interior angle, as described in claim 6, wherein said step of measuring and recording said length of said length for said first leg, $H_1$, said length for said second leg, $H_2$ and said first line, H3, further comprises using a height gauge to measure said lengths $H_1$, $H_2$ and H3.

* * * * *